United States Patent [19]

Takeda

[11] Patent Number: 4,813,247

[45] Date of Patent: Mar. 21, 1989

[54] APPARATUS FOR CLEANING OF CLOTHES

[75] Inventor: Toshio Takeda, Osaka, Japan

[73] Assignees: Takeda Seisakusho; Japan Vic Service, Co., Ltd., both of Osaka, Japan

[21] Appl. No.: 89,315

[22] Filed: Aug. 25, 1987

[51] Int. Cl.[4] ..... D06F 43/02; D06F 43/08

[52] U.S. Cl. ..... 68/18 C; 68/142

[58] Field of Search ..... 68/18 R, 18 C, 18 F, 68/58, 142

[56] References Cited

U.S. PATENT DOCUMENTS 1,183,632 5/1916 Collins et al. ..... 68/142

2,175,936 10/1939 Zimarik ..... 68/142 X 3,692,467 9/1972 Durr et al. ..... 68/18 F X

FOREIGN PATENT DOCUMENTS 486694 11/1929 Fed. Rep. of Germany ..... 68/142

820133 7/1937 France ..... 68/58

1408263 10/1975 United Kingdom ..... 68/18 C

*Primary Examiner*—Philip R. Coe

*Attorney, Agent, or Firm*—Irell & Manella

[57] ABSTRACT

A method for the cleaning of clothes comprising subjecting said clothes to a dry cleaning treatment with an organic solvent, subjecting said clothes to a washing treatment with water, and subjecting said clothes to a drying treatment, and an apparatus for the method.

6 Claims, 3 Drawing Sheets

APPARATUS FOR CLEANING OF CLOTHES

BACKGROUND OF THE INVENTION

1. Field of the invention

This invention relates to a method for the cleaning of clothes and an apparatus for the method.

2. Description of the prior art

Clothes that are worn by workers, for example, in a nuclear power station are stained by not only sweat but also radioactive substances. Such clothes are usually subjected to a dry cleaning so that radioactive substances can be removed, but sweat remains in the clothes. In order to solve this problem, the development of emulsive soaps for dry cleaning has been studied, but useful soaps have not yet been developed.

SUMMARY OF THE INVENTION

The method for the cleaning of clothes of this invention, which overcomes the above-discussed and numerous other disadvantages and deficiencies of the prior art, comprises subjecting said clothes to a dry cleaning treatment with an organic solvent, subjecting said clothes to a washing treatment with water, and subjecting said clothes to a drying treatment.

In a preferred embodiment, the clothes are stained by not only sweat but also radioactive substances.

The apparatus for the cleaning of clothes of this invention comprises a washing drum having a fixed drum with a plurality of concaved portions and a punched drum with a plurality of convexed portions that are formed on the interior surface thereof, said punched drum being concentric with said fixed drum and turning around the axis thereof within said fixed drum, a plurality of solvent-containers for supplying a solvent to said washing drum, a solvent-vaporizing means for vaporizing the used solvent from said washing drum, a condenser for condensing a vaporized solvent from said solvent-vaporizing means, a separator for separating a condensate from said condenser into a solvent and a water, a piping means for supplying the solvent from said separator to said solvent-containers, a gas-absorber for absorbing a solvent gas from said washing drum, a water-supplier for supplying water to said washing drum, a soap-supplier for supplying a soap to said washing drum, and a drier for drying said clothes within said washing drum.

In a preferred embodiment, the concaved portions of said fixed drum function to create whirling flows of a solvent and/or water within said washing drum and are formed such that the angle at the point of the intersection of the upstream-sided interior wall of each concaved portion and the interior wall of said fixed drum is an obtuse angle and the angle at the point of the intersection of the downstream-sided interior wall said concaved portion and the interior wall of said fixed drum is an acute angle.

In a preferred embodiment, the upstream-sided slanting surface of each convexed portion of said punched drum has gentle inclination and the downstream-sided slanting surface thereof has a steep inclination. In a more preferred embodiment, the upstream-sided slanting surface of each convexed portion of the punched drum is constituted by a punched substance, while said downstream-sided slanting surface thereof is constituted by a non-punched substance.

In a preferred embodiment, the punched drum further has a plurality of projections on the exterior surface thereof. In a more preferred embodiment, the downstream-sided surface of each of said protections is formed into a concaved shape.

Thus, the invention described herein makes possible the objects of (1) providing a method for the cleaning of clothes in which since a dry cleaning process using an organic solvent and a washing process using water are used in combination, clothes that have been stained by not only radioactive substances, etc., but also sweat are completely cleaned; and (2) providing an apparatus for the cleaning of clothes in which a washing drum comprises means for creating whirling flows and said means are formed into a streamline, so that a cleaning of clothes can be effectively carried out without damaging the clothes.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
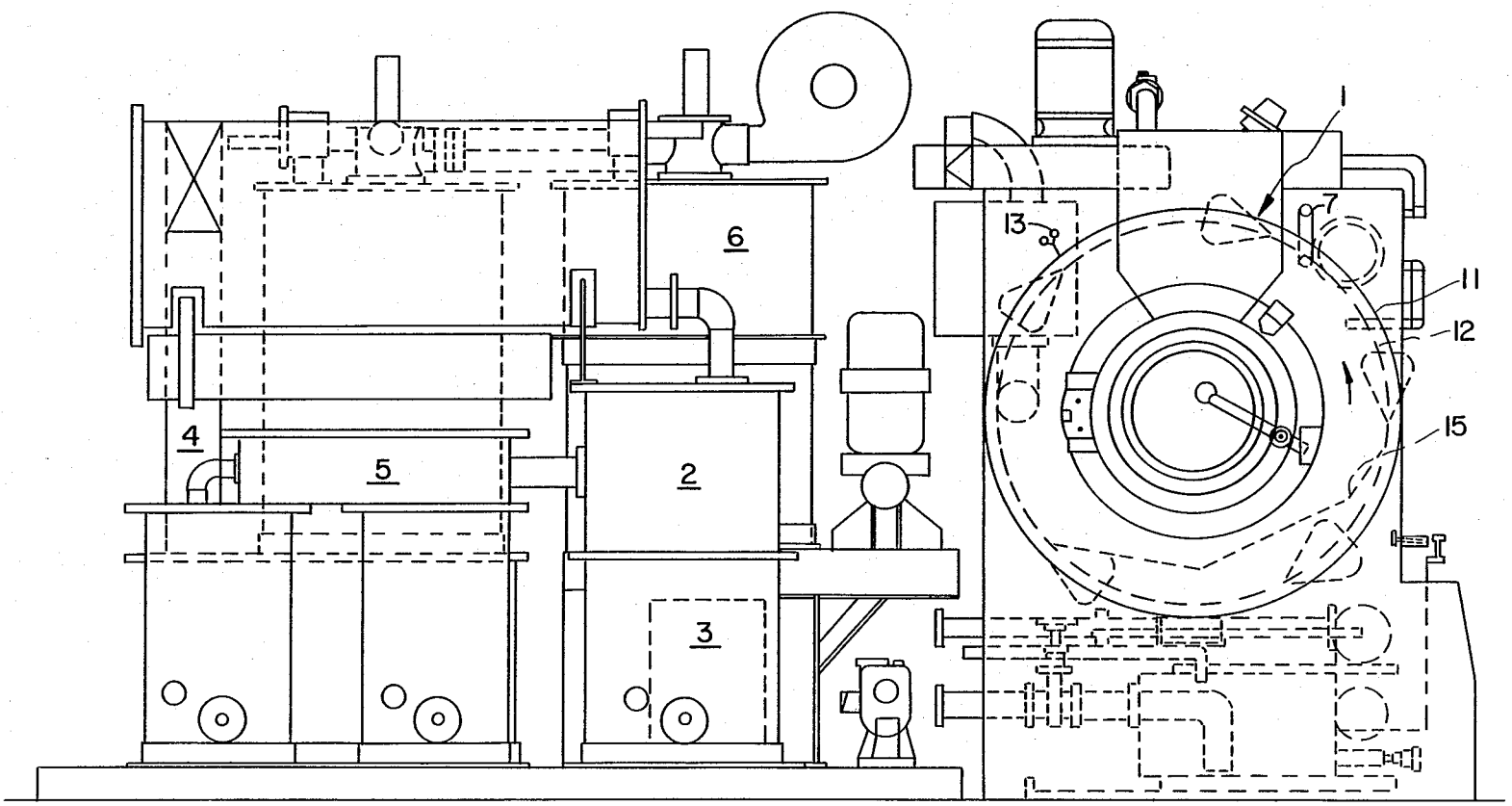
FIG. 1 is a side view showing an apparatus for the cleaning of clothes of this invention.
Figure 2:
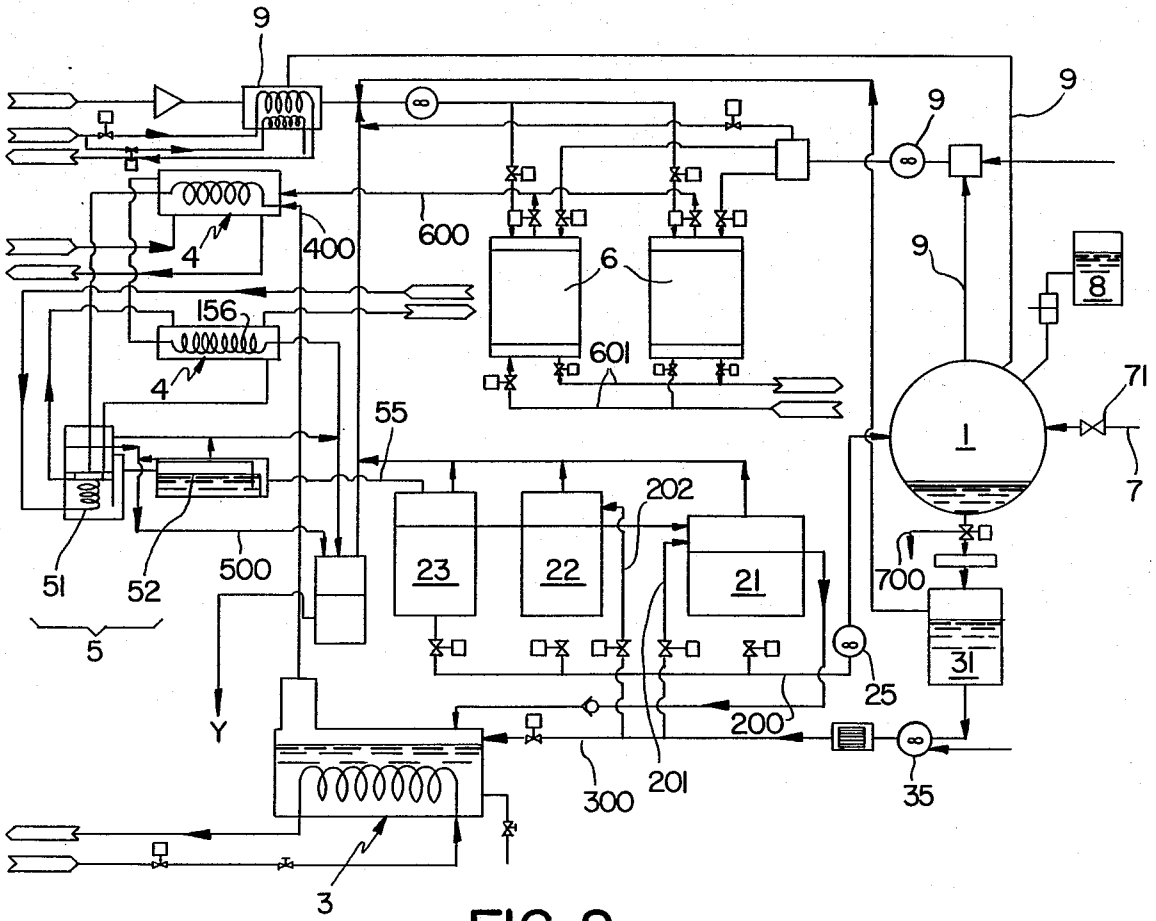
FIG. 2 is a diagram showing a method for the cleaning of clothes using the apparatus of FIG. 1.

FIGS. 1 and 2 show an apparatus of this invention, which comprises a washing drum 1 that is composed of a fixed drum 11 and a punched drum 12, a plurality of solvent containers 2 (e.g., a first solvent-container 21, a second solvent-container 22 and a third solvent-container 23) from which an organic solvent is supplied to the washing drum 1 via pipe line 200 by a pump 25, a solvent-vaporizing means 3 by which the solvent from the washing drum is vaporized, a condenser 4 by which the vaporized solvent from the solvent-vaporizing means 3 is condensed, a separator 5 by which a condensate from the condenser 4 is separated into a solvent and a water. The separator 5 is connected to the third solvent-container 23 by a piping means 55. This apparatus further comprise a gas-absorber 6 that absorbs a solvent gas arising within the washing drum 1, etc., a water-supplier 7 with an electron-magnetic valve 71 by which a given amount of water is supplied to the washing drum 1, a soap-supplier 8 by which a soap is supplied to the washing drum 1, and drying means 9. The drying means 9 is composed of a heater 91, a pump 92, pipe lines 900 and 901. Heated air is supplied to the washing drum 1 via a pipe line 900 by a pump 92, resulting in the vaporization of water and solvent within the washing drum 1. The resulting solvent gas is introduced to the gas-absorber 6 via the pipe line 901 by the pump 92.

Figure 3:
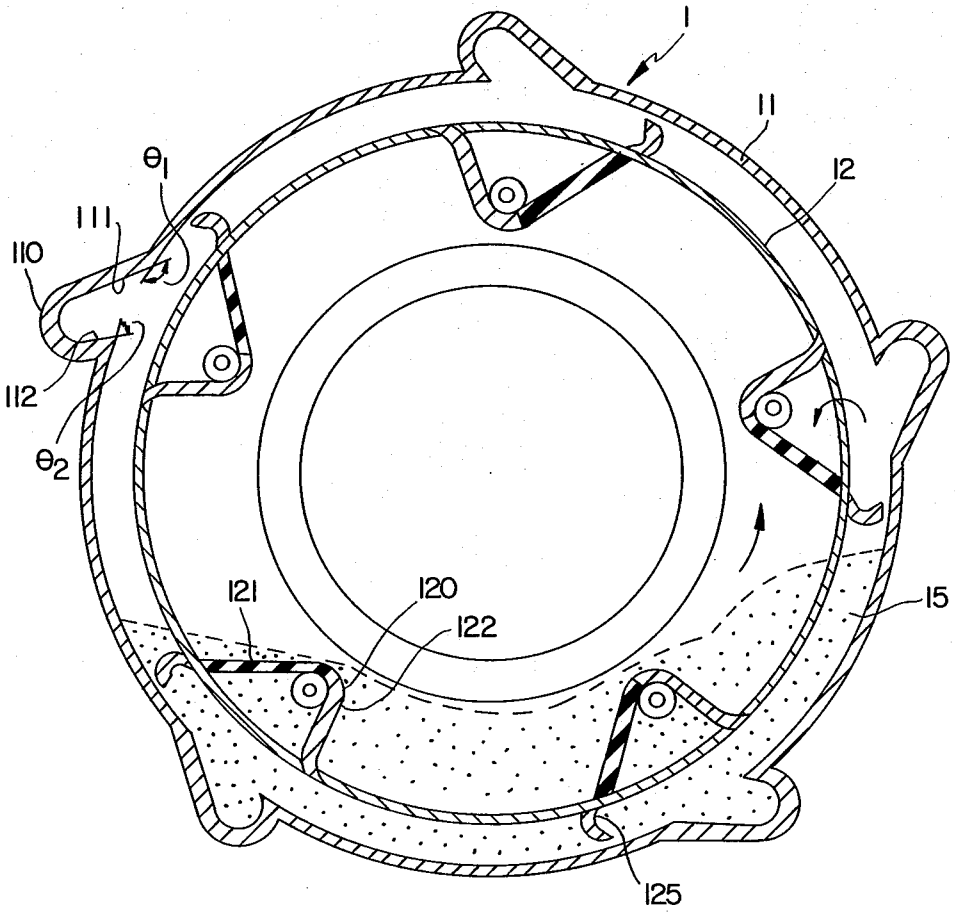
FIG. 3 is a side sectional view showing a washing drum of the apparatus of FIG. 1.

As shown in FIG. 3, the fixed drum 11 is provided with a plurality of concaved portions 110 that function to create whirling flows of a solvent 15 and/or water within the washing drum 1. The concaved portions 110 are formed into a streamlined shape such that the angle $\theta_1$ at the point of the intersection of the upstream-sided interior wall 111 of each concaved portion and the interior wall of the said fixed drum 1 is an obtuse angle and the angle $\theta_2$ of the point of the intersection of the downstream-sided interior wall 112 of the said concaved portion and the interior wall of the said fixed drum 11 is an acute angle. The punched drum 12 is positioned to be concentric with the fixed drum 11 and can turn around the axis thereof within the fixed drum 11. The punched drum 12 is provided with a plurality of convexed portions 120 that are formed into a streamlined shape on the interior surface thereof. The upstream-sided slanting surface 121 of each of the convexed portions 120 of the punched drum 12 has a gentle inclination and the downstream-sided slanting surface 122 thereof has a steep inclination. The downstream-sided slanting surface 122 is constituted by a non-punched substance that functions to raise and rumple the clothes. The slanting surface 122 also functions to create whirling flows of a solvent and/or water within the washing drum 1. The upstream-sided slanting surface 121 is constituted by a punched substance through which heated air can flow when it is supplied to the washing drum 1 so as to dry clothes in a drying process. The punched drum 12 is further provided with a plurality of projections 125 on the exterior surface thereof, so that when the punched drum 12 turns around the axis within the fixed drum 11, the projections 125 also work to create whirl flows of the solvent and/or water. For this purpose, the downstream-sided surface of each of the projections 125 is preferably formed into a concaved shape.

The first, second and third solvent-containers 21, 22 and 23 are disposed at higher positions in that order. Solvent from the separator 5 flows into the third solvent-container 23, first, via a pipeline 55 and a part of the solvent which flows over the third solvent container 23 flows into the second solvent-container 22. A part of the solvent which flows over the second solvent-container 22 flows into the first solvent-container 21.

The solvent-vaporizing means 3 comprises a tank and a heater (e.g., a pipe through which a stream flows) and is connected to the washing drum 1 by a solvent-transfer tank 31 via a pipe line 300. The transfer tank 31 is also connected to the first and second solvent-containers 21 and 22, respectively, via pipe lines 201 and 202. The condenser 4 with a cooler (e.g., a pipe through which a cooling water flows) is connected to the vaporizing means 3 by a pipe line 400. The vaporized solvent from the vaporizing means 3 is heat-exchanged within the condenser 4, resulting in a condensate. The condensate flows into the separator 5 that is composed of a first separator 51 and a second separator 52. The first separator 51 allows the condensate to separate into a solvent phase and a water phase by a difference in the specific gravity therebetween. The water phase positioned over the solvent phase is removed outside of this apparatus via a pipe line 500. The solvent phase is led to the second separator 52 in which the solvent is separated into a solvent phase and a water phase by a filter such as a glass filter. The solvent phase is led to the third solvent-container 23 via the piping means 55 and the water phase is removed outside of this apparatus via the pipe line 500.

The gas-absorber 6 is constituted by activated carbon. Solvent gases absorbed by the activated carbon of the gas-absorber 6 are removed from the activated carbon by supplying a stream to the gas-absorber 6 via a pipe line 601 and led to the condenser 4 via pipe line 600, in which the solvent gases are condensed, resulting in a condensate, which is then led to the first separator 51.

The water-supplier 7 that is connected to a water source (not shown) supplies an amount of water to the washing drum 1 based on an operation of the electromagnetic valve 71.

As a solvent, volatile solvents such as fluorocarbon that has a relatively low boiling point are used, examples of which are 1,1,2-trichloro-1,1,2-trifluoroethane, perchloroethylene, etc.

The method for the cleaning of clothes according to this invention is carried out as follows:

Clothes that are stained by a radioactive substance and sweat are thrown into the punched drum 12 of the washing drum 1. A certain amount of solvent is supplied from the first solvent-container 21 to the washing drum 1 by the motor 25. The punched drum 12 is rotated at a rate of 35 RPM for about 3 minutes. Due to the concaved portions 110 of the fixed drum 11 and the convexed portions 120, especially the downstream-sided surface 122, of the punched drum 12, the solvent vigorously and effectively whirls within the washing drum 1, so that the area of the clothes that comes into contact with the solvent becomes large, which allows an effective dry cleaning of the clothes. The projections 125 from the exterior surface of the punched drum 12 also function to assist the creation of whirling flows of solvent. The solvent is then withdrawn from the washing drum 1 to the solvent-transfer tank 31. The solvent is then led to the solvent-vaporizing means 3 via a pipe line 300 by a pump 35. The punched drum 12 of the washing drum 1 is rotated at a higher rate for about 45 seconds so that the removal of solvent from the clothes can be attained. Then, a certain amount of solvent is supplied from the second solvent-container 22 to the washing drum 1 by the pump 25. A certain amount of soap is also supplied from the soap supplier 8 to the washing drum 1. The punched drum 12 is rotated at a rate of 35 RPM for about 1.75 minutes. The solvent containing soap is withdrawn to the solvent-transfer tank 31 and led to the first solvent-container 21 via pipe lines 300 and 201 by the pump 35. The punched drum 12 is rotated at a higher rate for about 30 seconds so that the removal of the solvent containing soap from the clothes can be attained. Then, a certain amount of solvent is supplied from the third solvent-container 23 to the washing drum 1 by the pump 25. The punched drum 12 is rotated at a rate of 35 RPM for about 1.5 minutes. The solvent is withdrawn from the washing drum 1 to the solvent-transfer tank 31 and led to the second solvent-container 22 via pipe lines 300 and 202 by the pump 35. The punched drum 12 is rotated at a higher rate for about 2.25 minutes so that the removal of solvent from the clothes can be attained. A certain amount of solvent contained in the clothes is vaporized by heated air that is supplied by the pipe line 900 connected to the heater 91, and the vaporized solvent is introduced into the gas-absorber 6 via a pipe line 901 by the pump 92, so that the clothes can be dried. Since the upstream-sided slanting surface 121 of each of the convexed portions 120 of the punched drum 12 is constituted by a punched substance, the heated air readily flows therethrough, so that the area of the clothes that comes into contact with the heated air becomes large, which allows the clothes to be effectively dried. In this way, a dry cleaning treatment is completed. The solvent is completely recovered. The radioactive substance of the clothes is completely removed. After such a dry cleaning treatment with an organic solvent is repeated two to ten times, the clothes are subjected to a washing treatment with water. After the clothes are subjected to the washing treatment with water, they can be subjected to a further dry cleaning treatment with an organic solvent, as desired.

The washing treatment with water can be carried out as followed:

A certain amount of water is supplied from the water-supplier 7 to the washing drum 1 via the electro-magnetic valve 71. The amount of water required can be set by a leveling meter 13 connected to the valve 71. A certain amount of soap is also supplied from the soap supplier 8 to the washing drum 1. The punched drum 12 is rotated at a rate of 35 RPM for about 10 minutes. Then, the water is removed from the washing drum 1 via a pipe line 700. Heated air is then fed to the washing drum 1 via the pipe line 900, resulting in the vaporization of an amount of water remaining in the clothes, so that the clothes can be dried. The sweat of the clothes can be completely removed.

This apparatus can work under a well known automatic control of the rotation of the punched drum, necessary valves and pumps. Such an automatic control can be accomplished by the use of, for example, timers, a computer system, etc.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An apparatus for the cleaning of clothes comprising:

a washing drum having a fixed drum with a plurality of concaved portions, said concaved portions having an upstream-sided interior wall and a downstream-sided interior wall, said upstream-sided interior wall and said downstream-sided interior wall intersecting the wall of said fixed drum at an angle, wherein the angle between said upstream-sided interior wall and the interior of said fixed drum is obtuse and the angle between said downstream-sided interior wall and the interior of said fixed drum is acute, a punched drum with a plurality of convexed portions that are formed on the interior surface thereof, said punched drum being concentric with said fixed drum and turning around the axis thereof within said fixed drum, each of said convexed portions having a upstream-sided slanting surface and a downstream-sided slanting surface, a plurality of solvent-containers for supplying a solvent to said washing drum, a solvent-vaporizing means for vaporizing the used solvent from said washing drum, a condenser for condensing a vaporized solvent from said solvent-vaporizing means, a separator for separating a condensate from said condenser into a solvent and a water, a piping means for supplying the solvent from said separator to said solvent-containers, a gas-absorber for absorbing a solvent gas from said washing drum, a water-supplier for supplying water to said washing drum, a soap-supplier for supplying a soap to said washing drum, drying means for drying said clothes within said washing drum.

2. An apparatus according to claim 1, wherein the upstream-sided slanting surface of each convexed portion of said punched drum has gentle inclination and the downstream-sided slanting surface thereof has a steep inclination.

3. An apparatus according to claim 2, wherein said upstream-sided slanting surface of each convexed portion of the punched drum is constituted by a punched substance, while said downstream-sided slanting surface thereof is constituted by a non-punched substance.

4. An apparatus according to claim 1, wherein said punched drum further has a plurality of projections on the exterior surface thereof.

5. An apparatus according to claim 4, wherein the downstream-sided surface of each of said projections is formed into a concaved shape.

6. An apparatus for cleaning clothes comprising:

a washing drum having a fixed drum with a plurality of concaved portions, said concaved portions having an upstream-sided interior wall and a downstream-sided interior wall, said upstream-sided interior wall and said downstream-sided interior wall intersecting the wall of said fixed drum at an angle, wherein the angle between said upstream-sided interior wall and the interior of said fixed drum is obtuse and the angle between said downstream-sided interior wall and the interior of said fixed drum is acute;

a punched drum with a plurality of convexed portions that are formed on the interior surface thereof, said punched drum being concentric with said fixed drum and turning around the axis thereof within said fixed drum, each of said convexed portions having a gently-inclined upstream-sided slanting surface and a steeply-inclined downstream-sided slanting surface, wherein said upstream-sided surface is punched and said downstream-sided surface is non-punched, said punched drum further comprising a plurality of projections on the exterior surface, said projections having a concave shape on the downstream side;

a plurality of solvent-containers for supplying a solvent to said washing drum;

a solvent-vaporizing means for vaporizing the used solvent from said washing drum;

a condenser for condensing a vaporized solvent from said solvent-vaporizing means;

a separator for separating a condensate from said condenser into a solvent and a water;

a piping means for supplying the solvent from said separator to said solvent-containers;

a gas-absorber for absorbing a solvent gas from said washing drum;

a water-supplier for supplying water to said washing drum;

a soap-supplier for supplying a soap to said washing drum; and drying means for drying said clothes within said washing drum.

* * * * *